United States Patent [19]

Briles

[11] 3,933,025

[45] Jan. 20, 1976

[54] HIGH SPEED RIVETING SYSTEM

[76] Inventor: Franklin S. Briles, 3600 Catamaran, Corona Del Mar, Calif. 92625

[22] Filed: May 3, 1974

[21] Appl. No.: 466,536

Related U.S. Application Data

[63] Continuation-in-part of Ser. No. 455,555, March 28, 1974.

[52] U.S. Cl. ..... 72/391; 29/243.54

[51] Int. Cl.[2] ..... B21J 15/20; B21J 15/30; B23P 11/00

[58] Field of Search ..... 29/243.53, 243.54; 72/391, 72/453, 465; 173/2, 133; 227/8

[56] References Cited

UNITED STATES PATENTS

| | | | |
|---|---|---|---|
| 2,722,918 | 11/1955 | Kimball | 173/133 |
| 3,088,440 | 5/1963 | Wilmer | 173/2 |
| 3,348,751 | 10/1967 | Henning | 227/8 |
| 3,478,567 | 11/1969 | Galutia | 29/243.54 |
| 3,581,373 | 6/1971 | Murdoch et al. | 29/243.54 |
| 3,704,506 | 12/1972 | Orr et al. | 29/243.54 |
| 3,747,194 | 7/1973 | Christensen | 29/243.54 |
| 3,782,483 | 1/1974 | Wandell | 173/133 |

FOREIGN PATENTS OR APPLICATIONS

| | | | |
|---|---|---|---|
| 446,621 | 2/1948 | Canada | 29/243.54 |
| 800,470 | 1/1936 | France | 29/243.54 |
| 1,580,439 | 9/1969 | France | 72/391 |

*Primary Examiner*—C. W. Lanham
*Assistant Examiner*—E. M. Combs
*Attorney, Agent, or Firm*—William W. Haefliger

[57] ABSTRACT

A gun for upsetting the shank terminal of a metallic rivet projecting through work is operable after back-up force is applied to the rivet head. An anvil may be employed to form the upset in such manner that the rivet shank in the work bore, and the bore itself, may be controllably expanded.

10 Claims, 12 Drawing Figures

AIR

HIGH SPEED RIVETING SYSTEM

BACKGROUND OF THE INVENTION

This application is a continuation-in-part of Ser. No. 455,555 filed Mar. 28, 1974.

This invention relates generally to riveting apparatus and systems, and more particularly concerns riveting equipment facilitating more rapid and efficient riveting with associated substantial reduction in noise levels.

At the present time there are many problems involved in the riveting of panels, as for example in aircraft fabrication. Among these are the requirement for the delivery by a rivet gun of a large number of blows or impacts to the rivet head, in order to gradually upset the rivet shank terminal, a so-called heavy mass or "bucking bar" being held against that terminal to form the upset. Not only is this procedure extremely noisy, but it also produces rapid oscillation of the rivet back and forth in the panel bore during the riveting process, which tends to gall the bore and remove anodizing on the rivet shank due to back and forth frictional contact of the shank with the bore. Further, the impact shock loading or hammering is repeatedly delivered via the rivet head to the work panels, tending to separate them slightly at their interface, and resulting in an undesirably loose riveted connection and/or buckling of one or both panels, in many instances. Additional problems include unwanted flattening and cracking of rivet heads, marring of the panels, so-called clinching of the upset and tipping or cutting of the driven head.

SUMMARY OF THE INVENTION

It is a major object of the invention to provide solutions to the above problems, through the provision of the riveting equipment and system to be described. Basically, certain apparatus applies back-up force to the rivet head tending to keep the rivet in fully inserted position in the work, with the rivet head urged toward the work; and, other apparatus delivers an impact to the protruding rivet shank terminal in a direction to urge the terminal toward the bore in the work, the impact delivered with such high impact velocity as to radially expand and axially shorten the bulk of the terminal, thereby to form an upset engaging the side of the work opposite the head, while the head remains in close adjacency to the work. As will be seen, safety means prevents operation of the gun until the bucking bar is applied to the work. Accordingly, major impact force is not transmitted to the work via the head, but is rather employed to directly form the upset, at such high speed that the rivet head is not undesirably displaced relatively away from the work. As will appear, the upset is preferably formed in response primarily to only a single impact, to reduce the noise levels to a minimum and to virtually eliminate rapid endwise oscillation of the rivet in the work during upset formation. Also, initial force (prior to impact) is exerted of applied against the work opposite sides in order to prevent separation of work panels during upset formation as described.

Other objects include the provision of an anvil for confining the tip of the rivet terminal against radial expansion while the bulk of that terminal undergoes radial expansion, thereby to form a centering indicator at the tip of the upset; the control of rivet shank expansion; the provision of control means including a valve operated by the worker holding a bucking bar, to prevent operation of the upset forming gun until back-up force is applied to the rivet head; the provision of a trigger operated valve at the gun to control application of control pressure to a control valve which in turn releases working pressure to a plunger driving piston; the provision of a safety valve to prevent application of pneumatic pressure to the piston of the gun until the gun has been applied to the work; and the provision of means to adjust the length of the gun barrel to thereby adjust the plunger stroke and subsequently to strike the anvil with controllable impact.

These and other objects and advantages of the invention, as well as the details of an illustrative embodiment, will be more fully understood from the following description and drawings, in which:

DRAWING DESCRIPTION

DETAILED DESCRIPTION

Figure 1:
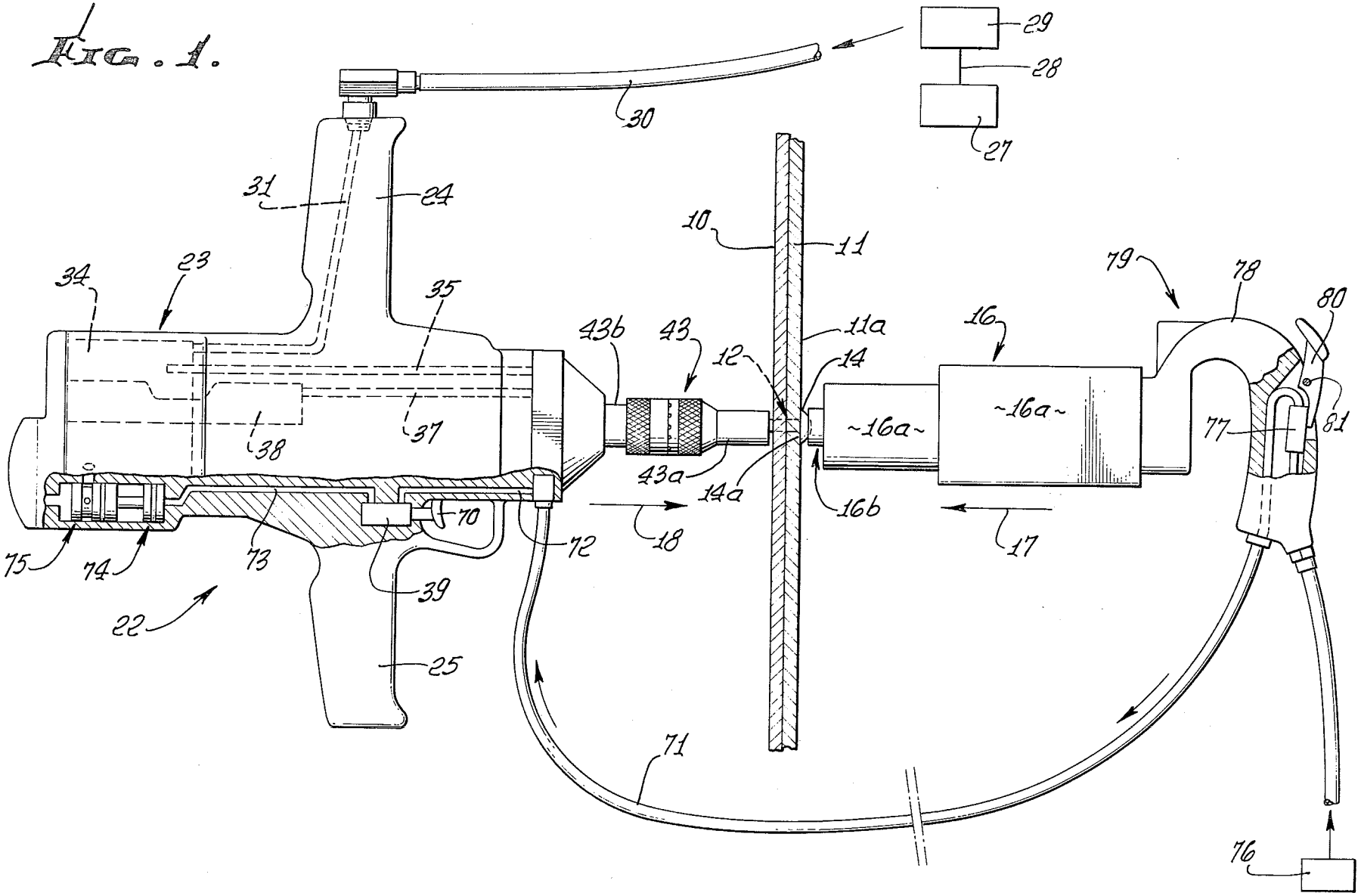
FIG. 1 is a side elevation showing a riveting system incorporating the invention.

In the drawings, the work is shown in the form of two panels or skins 10 and 11 to be interconnected as by a rivet or rivets 12; however, the work may take other forms. The rivet is shown as inserted into a bore 13 that extends through both panels, with the rivet head 14 at one side of the work. The shank 15 includes a portion **15*a* within the bore, a terminal portion 15*b* protruding from the bore at the opposite side of the work, and a tip at 15*c***. The rivet may have loose fit, push fit or other fit in the bore as desired.

In this environment, a system for securing the rivet to the work includes first means at one (right) side of the work applying back-up force to the rivet head tending to urge the head toward the work. Such first means may for example include a so called bucking bar 16, having heavy metallic mass or body portions **16*a* and a terminal 16*b* that may be concavely recessed at 16*c* to fit the domed curvature of the rivet head. Force exerted via the bucking bar, as indicated by arrow 17, is transmitted to the head 14, and then to the work panel 11 tending to keep the inner face 14*a* of the head engaged with side 11*a*** of that panel. Such steady force may, for example, be less than 50 pounds.

Figure 8:
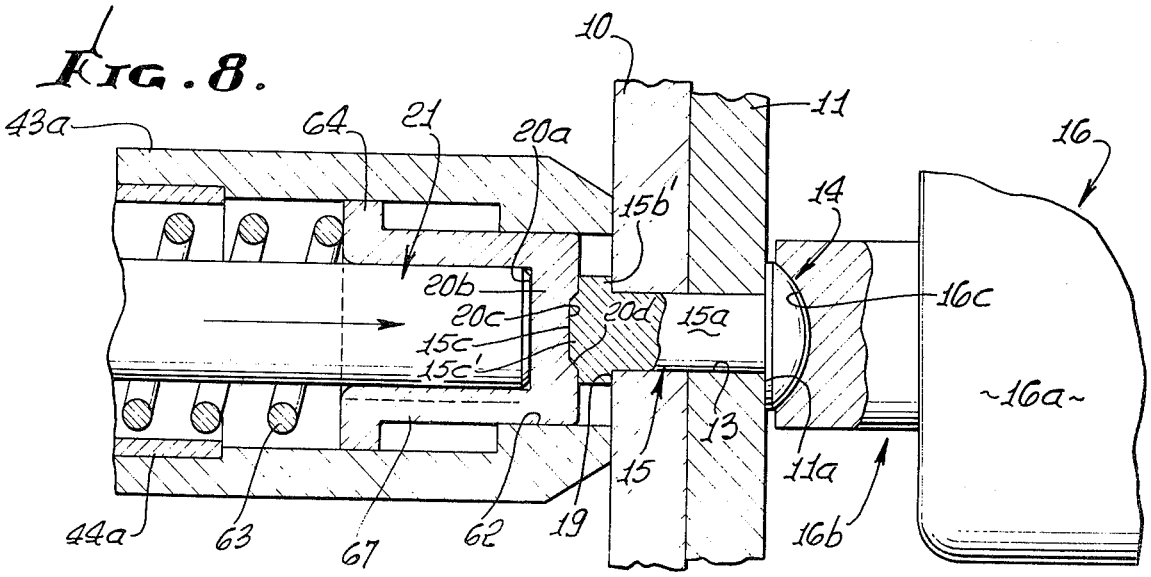
FIG. 8 is a view like FIG. 7 showing system components applied to the rivet and work during rivet deformation.

The system also includes second means at the opposite (left) side of the work for delivering an impact to the rivet shank terminal 15*b* in a longitudinal axial direction (indicated by arrow 18) tending to urge that terminal toward bore 13, and with sufficient impact velocity as to radially expand and axially shorten the bulk of the terminal, thereby to form an upset (as at 15*b'* in FIGS. 5 and 8) engaging the opposite side of the work (as at 19 in FIGS. 5 and 8) while the head 14 extends or remains closely adjacent the one side of the work, as at surface 11*a*. The upset is preferably formed in response primarily to only a single impact, as described, so that the rivet does not oscillate in bore 13, and the time required to form the upset is minimized. Also, impact force is utilized to form the upset rather than being substantially dissipated by transmission via the rivet head to the work, as in the past. Note that the head surface 14*a* remains engaged against the work surface 11*a* during completion of upset formation, whereby a tight rivet connection to the work is always assured. These conditions may be met when the velocity of impact exceeds about 800 to 1,000 feet per second. Merely as illustrative, the materials of the rivet and panels may be selected from the group consisting of aluminum, aluminum alloys, titanium and titanium alloys, and other ferrous and non-ferrous metals and alloys.

The referenced second means may, with unusual advantage, include a gun 22 having structure such as anvil 20 for engaging the tip 15*c* of the rivet shank terminal, and a plunger 21 to deliver the high velocity impact to the anvil at inner surface 20*a* thereof for impact transfer to the rivet head. The illustrated gun 22 also includes a body 23 and a pair of handles 24 and 25 enabling it to be held by a worker, using both hands. Pneumatic means including a piston is provided to drive the plunger or striker forwardly, such means including for example a compressed air source 27 seen in FIG. 1 as supplying air via line 28, air pressure regulator, cleaner and lubricator 29, and line 30 to the gun 22 via handle 24. Within the latter, air flows via duct 31 to air reservoir 34. From that reservoir, air passes via duct 35 to a poppet type safety valve generally indicated at 36, in FIG. 5, and which, when opened, passes air pressure to a trapped air chamber 38 via duct 37. A trigger controlled valve, indicated at 39 in FIG. 1, controls sudden release of pressurized air from chamber 38 to the main cylinder or bore 40 to drive piston 41 therein forwardly. The elongated striker or plunger 21 has an enlarged section 21*b* connected via nut 41*a* and screw 42 to the center of the piston.

Figures 2, 3, 9, 10:
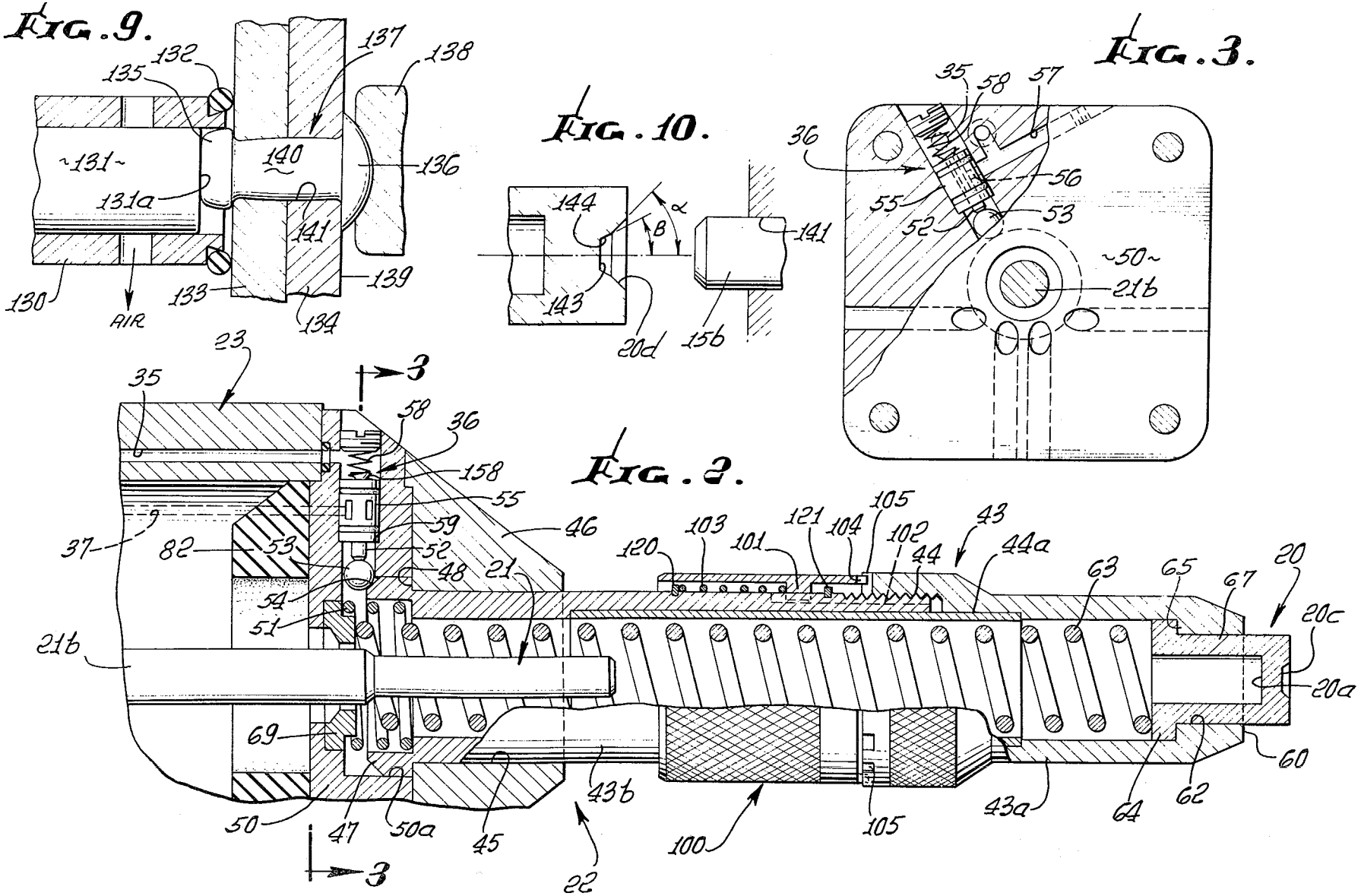
FIG. 2 is an enlarged fragmentary elevation, taken in section of the forward portion of the riveting gun shown in FIG. 1, and prior to application to a fastener inserted into a work bore.
FIG. 3 is a section taken on lines 3—3 of FIG. 2, and partially broken away to show interior details.
FIGS. 9 to 12 show modifications, including a rivet.
Figure 4:
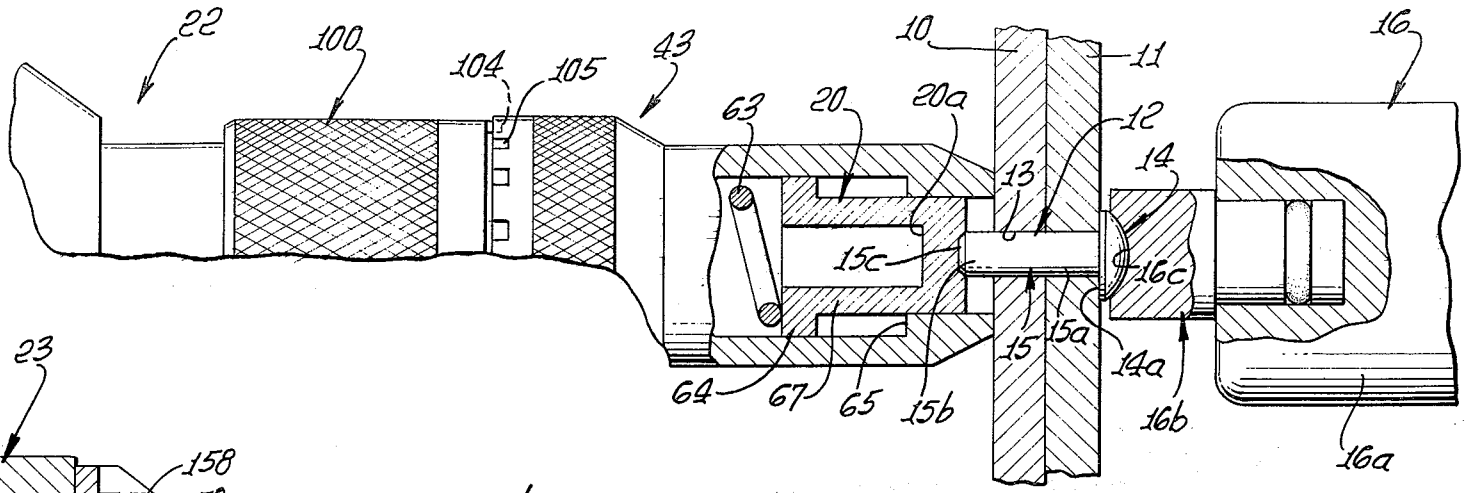
FIG. 4 is an enlarged vertical section showing application of the FIG. 1 system components to a rivet inserted into a work bore.

With regard to safety valve 36, it is openable to pass pneumatic pressure to chamber 38 only in response to application of the gun to the work, as for example forward movement of the gun body 23 relative to an outer barrel 43 carried by the body. The barrel 43 includes sections 43*a* and 43*b* which have threaded interconnection at 44, make-up being limited by an inner sleeve 44*a*. Section 43*b* is carried for guided, limited axial movement in bore 45 of body nose section 46, a flange 47 on that barrel section being alternately engageable with shoulder 48 on nose section 46 and shoulder 49 on adapter block 50 to limit such movement. A compression spring 51 normally urges barrel 43 forwardly relative to the body, as seen in FIG. 2, allowing the poppet valve plunger 52 to be spring urged downwardly to close position, a large ball 53 coupling mechanically between that plunger and the cam surface 54 on the barrel rear flange 47. The poppet valve plunger works within a cylinder 55 to open and close communication between ducts 35 and 37, as via a side duct 56 in valve cylinder 55, and auxiliary duct 57 in block 50, as seen in FIG. 3. Cylinder 55 is resiliently urged at 58 against stop 59, and air pressure exerted on the poppet head 158 normally urges the plunger 52 against ball 53. When the forward end 60 of barrel section 43*a* is held against the work surface 10*a*, and the gun body 22 advanced toward the work and relative to barrel 43, the rear flange 47 displaces ball 53 radially outwardly to also move plunger 52 outwardly opening the safety valve by unseating the poppet head 158. Flange 47 works within a bore 50*a* in block 50. Accordingly, working air pressure can flow to chamber 38 only after the gun has been applied to the work.

The barrel 43 may be considered as an element of tubular means carried by the body to project forwardly, such tubular means also including the anvil 20 for receiving the plunger or 21 striker. The anvil has slidable reception within the bore 62 of the barrel forward section 43*a*, and a compression spring 63 urges the anvil forwardly so that normally an anvil flange 64 engages step shoulder 65 formed by barrel section 43*a*. The opposite ends of spring 63 engage flange 64 and a ring 69 retained in block 50, as shown, that ring also seating one end of spring 51.

A further aspect of the invention concerns the provision of means to confine the tip 15*c* of the rivet terminal against radial expansion while the bulk of the terminal 15*b* undergoes such expansion to form the upset, thereby to form a centering indicator at the tip of the rivet. See in this regard the example of such an indicator at 15*c'* in FIG. 8. An inspector can very quickly ascertain, by viewing such an indicator 15*c'*, whether it is concentric as related to the expanded upset 15*b'*. If the latter is concentric, the upset is correctly formed, whereas if it is not concentric, (as for example oval shaped) the existence of an out-of-round condition of the upset and its azimuthal bulge direction, are immediately evident, in relation to the location of the indicator 15*c'* which always remains centered.

For the above purpose, the anvil end wall 20*b* typically forms a centered recess 20*c* shaped to receive and confine the rivet tip 15*c* during the impact delivery, via that tip, to the rivet terminal portion 15*b* subjected to radial expansion and axial compression. Annular tapered wall 20*d* of the recess blocks radial expansion of the tip during the formation of the upset.

Maintenance of the recess 20*c* in centered and centering engagement with the tip 15*c* may be achieved, in unusually advantageous and simple manner as described below. Firstly, preliminary interfitting of the anvil and rivet shank tip, as described, as aided by compression spring 63, urges the anvil toward the rivet. Note that the end of spring 63 engages the anvil flange 64, which is guided by a counterbore wall 66 in tubular part of barrel 43*a* for axial movement; also, the anvil skirt 67 may have axial guided engagement with bore wall 62 in the part 43*a* for centering purposes. Initially, therefore, the anvil recess 20*c* receives the rivet tip 15*c* and the barrel 43 is thereby centered in relation to the rivet as the barrel terminal 60 is pushed into forcible engagement with the work surface 10*a*. Such engagement is thereafter forcibly maintained during formation of the upset 15*b'* and the force transmitted between barrel terminal 60 and wall 10*a* develops frictional force resisting lateral displacement of the barrel, anvil and rivet terminal during upset formation, further facilitating the maintenance of the centered conditions as described. Accordingly, problems of malformation of the upset are eliminated or minimized.

Control means is provided to effect application against the piston 41 of fluid pressure sufficient to drive the plunger 21 forwardly in one stroke to substantially fully upset the rivet shank terminal. Such control means includes a trigger 70 operable to open valve 39 to pass control air pressure from line 71 and duct 72 in body 23 to duct 73 in that body. Such pressure shifts spool valve elements 74 and 75 to the left, thereby unblocking the passage of pneumatic pressure from chamber 38 to the main cylinder or bore 40 for driving the piston 41 forwardly. Pressure delivery to line 71, as from source 76, may be valve controlled at 77 at the side of the work panels opposite the gun 22 and plunger 21, so that the worker who applies the bucking bar 16 can control application of impact force to the rivet, preventing inadvertent impact delivery to the rivet prior to his application of the bar 16 to the rivet head; otherwise, such impact delivery could "shoot" the rivet from the work and possibly injure personnel. Valve 77 may be carried in the handle 78 of a bucking tool 79, and to which the bar 66 is attached, as shown. A thumb trigger 80 pivotally attached to the handle 78 at 81, controls the valve 77.

Finally, means is provided to adjust the effective stroke of the plunger 21 in its travel to strike the anvil, so that the rivet end may be upset to desired extent, such adjustment allowing use of the gun 22 to form rivet upsets of different sizes and materials in relation to the work wherein the bores may also vary. Such means may with unusual advantage include means to retain the barrel sections **43*a* and 43*b* at a selected adjustment (at telescopic interconnection 44) corresponding to a selected overall length of sections 43*a* and 43*b*. This in turn controls the spacing between the forward terminal of the plunger (which strikes the anvil) and the elastomer cushion or pad 82** which is compressed by the piston at the end of its strike.

Figure 5:
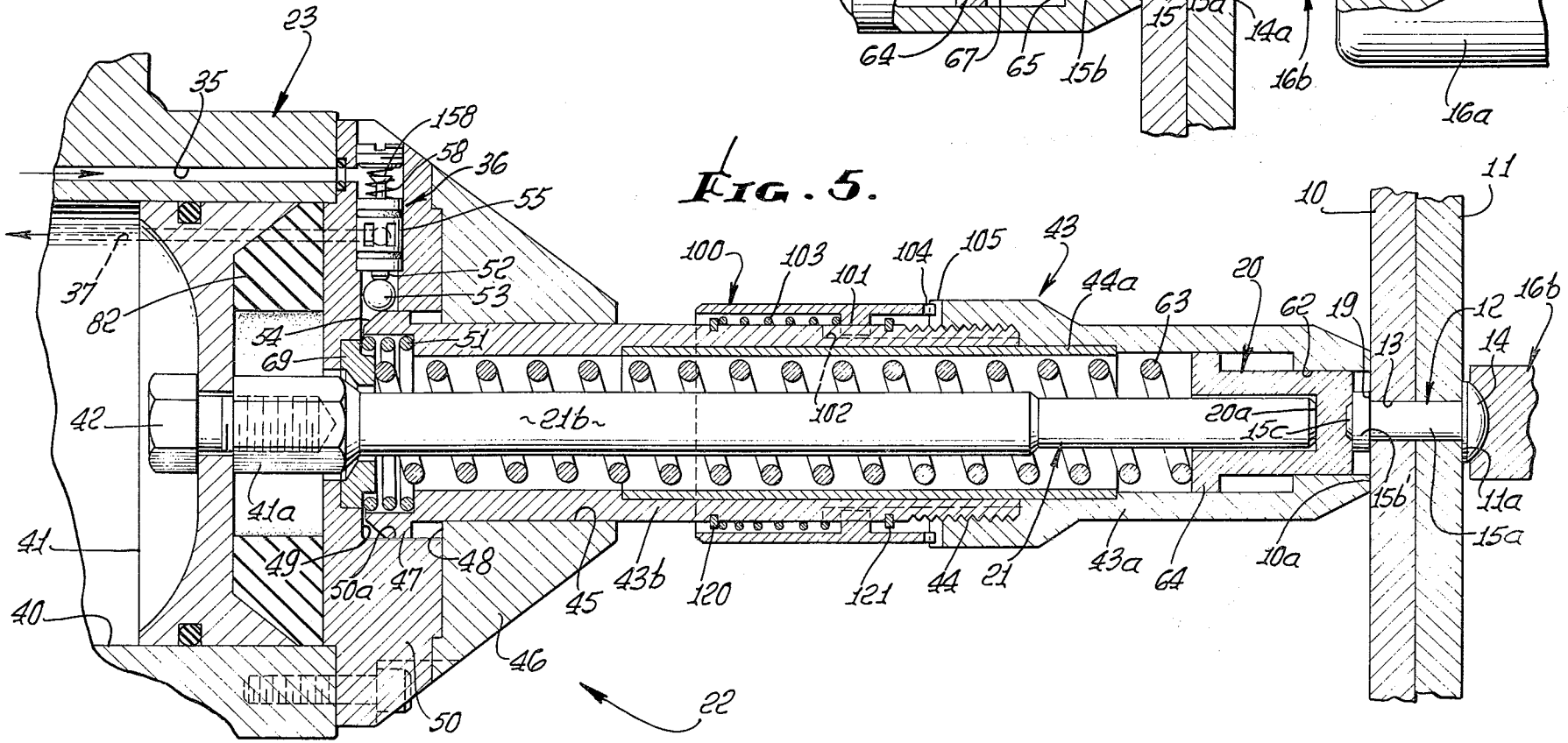
FIG. 5 is an enlarged elevation like that of FIG. 2, showing the gun components during force application to the rivet.
Figure 6:
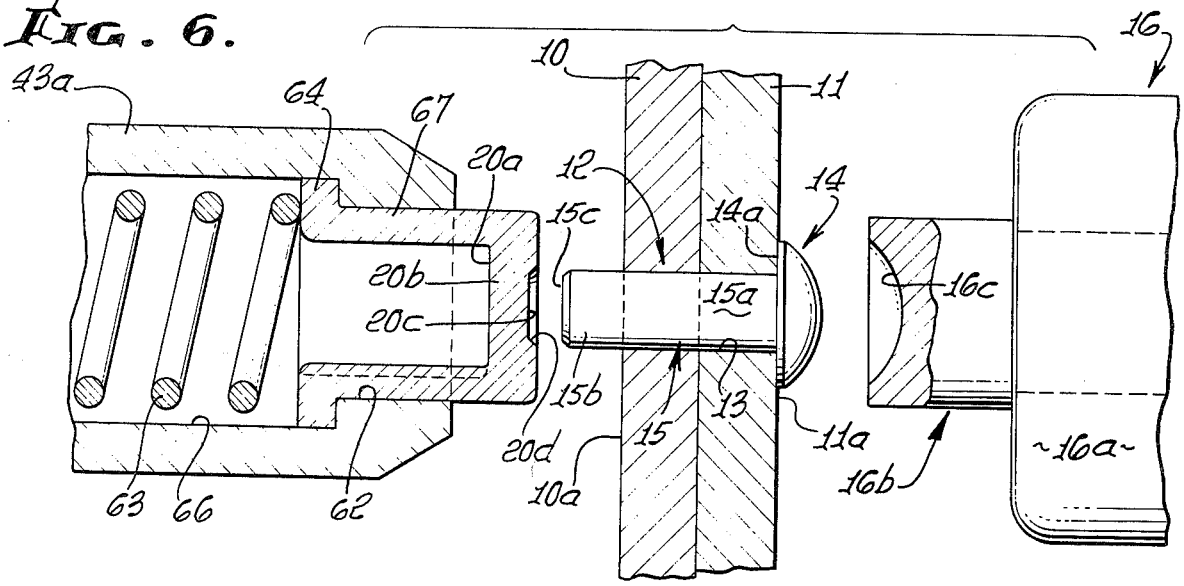
FIG. 6 is an enlarged fragmentary elevation showing system components in relation to a rivet, prior to riveting.

As shown in FIGS. 2 and 5, a keeper ring 100 is slidable along the barrel section **43*b*, with keys 101 riding in keyways 102 to block ring rotation. A spring 103 urges the ring forwardly to teeth 104 may penetrate selected annularly spaced slots 105 in the enlarged left end of the section 43*a*, blocking relative rotation of the sections 43*a* and 43*b*. Such relative rotation, for adjustment of overall length of these sections, may be effected after rearward displacement of ring 100 against spring 103 to disengage teeth 104 from the slots, followed by reengagement of the teeth in other slots. Note retainer rings 120 and 121**, functioning as shown.

FIG. 9 shows a modified gun barrel 130 containing a forwardly movable plunger 131. Elastomeric means, as for example a rubber O-ring 132, is carried at the forward end of the barrel to engage the work panel and resist sideward slippage or movement of the barrel relative to the work panels 133 and 134 during forward travel of the plunger. The latter has a substantially flat forward end face or surface **131*a* to strike the rivet shank terminal, forming the upset 135. The head 136 of the rivet 137 is retained by bucking bar 138 against the surface 139 of the work 134. Note that some expansion of the rivet shank 140 occurs, producing corresponding expansion of the work bore 141** producing radial compression and peripheral tension, as is desirable.

Figure 7:
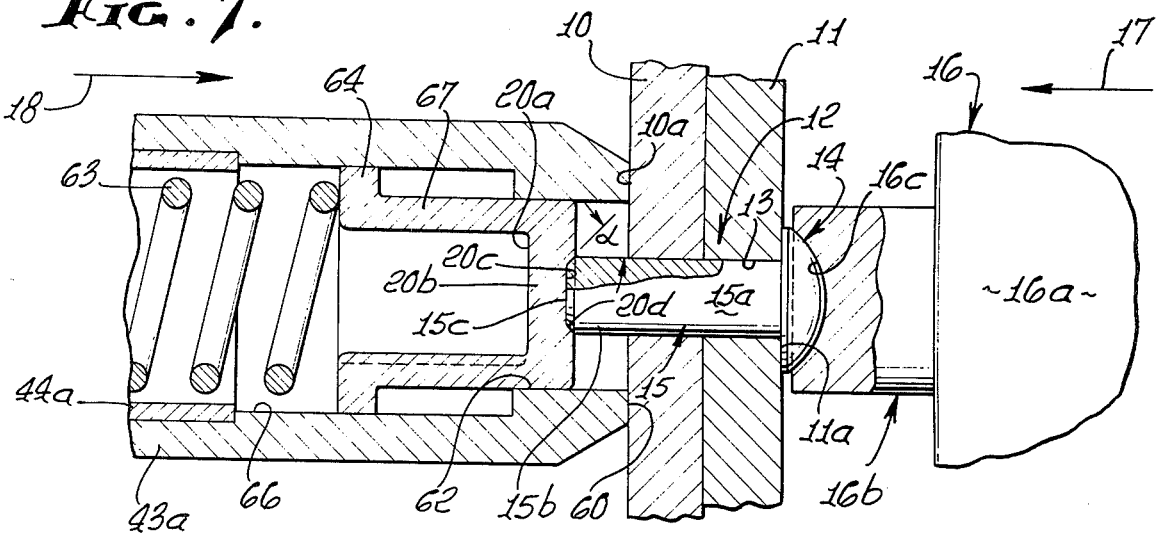
FIG. 7 is a view like FIG. 6 showing system components applied to the rivet and work, but prior to rivet deformation.

A greater degree of bore expansion can be achieved using the anvil 20 previously described. It is found that the extent of such expansion can be controlled by controlling the conical angle $\alpha$ of the anvil surface **20*d* appearing in both FIGS. 7 and 10, i.e. the more acute the angle, the greater the expansion of the work bore, also indicated at 141 in FIG. 10. Such angularity controls the concentration of at least a portion of the impacting at the center portion of the shank terminal 15*b* in FIG. 10, during upset formation, to transmit sufficient force into the rivet within the bore so as to controllably expand the rivet shank in the bore. In addition, the modified anvil of FIG. 10 shows an interior frusto-conical recess 143 deeper than the frusto-conical recess formed by surface 20*d* and having a conical wall 144 the cone angle $\beta$ of which is normally less than the angle $\alpha$. That recess and wall 144 contribute along with surface 20*d*** to enhancement and greater control of expansion of the rivet shank in the bore, during upset formation. For example, controllable hole expansion between 0.002 and 0.010 inches in overall diameter may be achieved, using a rivet metal softer than the metallic material of the work panels (for example, a 33,000 ksi rivet in a 72,000 ksi panel).

Figure 11:
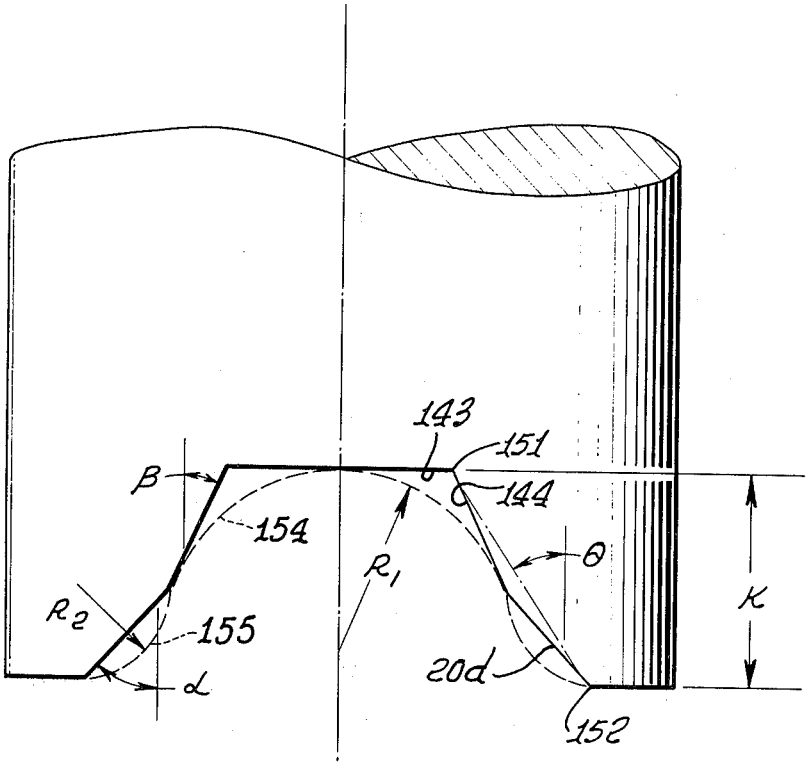

FIG. 11 shows in greater detail the design of the modified anvil **20*a* as shown in FIG. 10. The angle $\alpha$ lies between 30° and 80°, and the angle $\beta$ lies between 5° and 50 °. In addition, the angle $\theta$ lies between 25° and 75°, where the angled line 150 connects points 151 and 152** at the innermost and outermost edges of the recesses. For a rivet diameter ranging between 1/16 and 13/32 inch, the dimension "K" lies between 0.025 and 0.200 inch.

Curved and broken lines 154 and 155 indicate optional inner and outer recess walls where the radius $R_1$ of spherical wall 154 is approximately equal to one-half the rivet diameter, and where the radius of curved annular surface 155 is indicated at $R_2$. Surface 154 is forwardly concave whereas surface 155 is forwardly convex.

Figure 12:
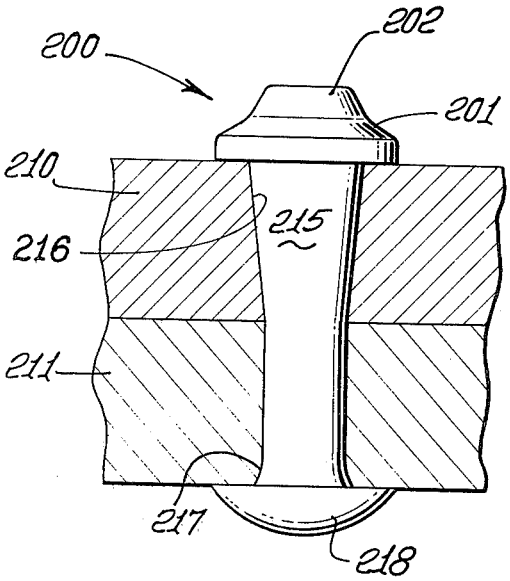

A typical rivet formed by the anvils of FIGS. 10 or 11 is seen in FIG. 12. Note that the upset 200 has surfaces 201 and 202 corresponding to and formed by anvil surfaces **20*d* and 144, respectively. Thus, the frusto-conical angularity of surface 201 exceeds that of surface 202. Concentration of force into the rivet shank 215 upon formation of the upset 200 results in expansion of the shank to form reverse frusto-conical taper at 216, and which tends to lock the rivet to panel or skin 210. Taper 216 flares toward the upset 200. If panel or skin 211 is of sufficiently soft material, a localized reverse taper tends to form at 217 adjacent the head 218, and locking the rivet to panel 211**. Typical rivet materials include aluminum, Monel, stainless steel, copper and brass.

I claim:

1. In a gun for upsetting the shank terminal of metallic rivet projecting through work, the rivet also having a head spaced from said terminal, the combination comprising a. structure including a plunger to be driven forwardly for transmitting upsetting force to be delivered to said terminal, b. means including a piston to drive the plunger forwardly after back-up force is applied to the rivet head, c. a chamber to store working fluid pressure, a control valve, and a trigger actuated valve for releasing the passage of control fluid pressure to operate the control valve for releasing working fluid pressure to actuate the piston, d. said structure including a forwardly extending tubular barrel, and an anvil element carried by and movable relative to the barrel between the plunger and rivet terminal to receive said upsetting force and to transmit same to the rivet terminal, there being a spring urging the anvil element forwardly relative to the plunger, the anvil extending in front of the plunger, the anvil element having generally frusto-conical recess means to receive and confine the tip of the rivet terminal during upset formation, said recess means including first and second conical recesses, the first recess located between the second recess and the forward end of the anvil, the first and second recesses defining respective generally conical angles $\alpha$ and $\beta$, and wherein $\alpha$ is substantially greater than $\beta$.

2. The gun of claim 1 wherein said gun includes a gun body carrying said chamber, said control valve and said trigger operated valve.

3. The gun of claim 1 wherein the gun includes a body which carries the barrel so that the body is movable axially forwardly to limited extent relative to said barrel when the barrel forward terminal engages the work, and a safety valve openable to pass plunger operating pneumatic pressure to a holding chamber within said body in response to said body forward relative movement.

4. The gun of claim 3 wherein the gun includes a block containing said safety valve, the block having a bore receiving rearward extent of the barrel for relative movement therein, and there being a mechanical coupling between the safety valve and said rearward extent of the barrel to open the safety valve when the block moves forwardly relative to the barrel and to close the safety valve when the block moves rearwardly relative to the barrel, there being means resiliently biasing the barrel forwardly relative to the block.

5. The gun of claim 1 including a source of said working fluid pressure communicating with said storage chamber, said working fluid pressure being sufficient to drive the piston and plunger toward the rivet at a velocity of at least about 800 to 1,000 feet per second.

6. The combination of claim 4 including the work in the form of panels, one of which is urged toward the other by the barrel for effecting opening of said safety valve.

7. The gun of claim 1 including elastomeric means at the end of the barrel to engage the work to resist sideward slippage of the barrel relative to the work during forward travel of the plunger within the barrel.

8. The gun of claim 7 wherein the plunger has a substantially flat forward end surface to strike the rivet shank terminal.

9. The combination of claim 1 wherein said first and second recesses are defined by first and second annular surfaces, the first surface being located between the second surface and the forward end of the anvil, said first surface merging with the forward end of the anvil and also with said second surface.

10. In a gun for upsetting the shank terminal of a metallic rivet projecting through metallic work, the rivet also having a head spaced from said terminal, the combination comprising a. a barrel and a plunger to be driven forwardly therein, b. and an anvil located in the barrel to be struck and driven forwardly by the plunger, the anvil having generally frusto-conical recess means opening forwardly to concentrate impact at the center of the rivet terminal during upset formation to effect controllable expansion of the rivet shank in the work, said frusto-conical recess means including first and second conical recesses, the first recess located between the second recess and the forward end of the anvil, the first and second recesses defining respective conical angles $\alpha$ and $\beta$, and wherein $\alpha$ is substantially greater than $\beta$ and $\alpha$ is between 30° and 80° and $\beta$ is between 5° and 50°.

* * * * *